United States Patent [19]

Laapotti

[11] Patent Number: 4,976,820

[45] Date of Patent: Dec. 11, 1990

[54] METHOD FOR HOT-PRESSING OF A WEB

[75] Inventor: Jorma Laapotti, Palokka, Finland

[73] Assignee: Valmet Paper Machinery Inc., Finland

[21] Appl. No.: 187,259

[22] Filed: Apr. 28, 1988

[30] Foreign Application Priority Data

Apr. 28, 1987 [FI] Finland ..... 871870
Feb. 15, 1988 [FI] Finland ..... 880700

[51] Int. Cl.[5] ..... D21F 3/00
[52] U.S. Cl. ..... 162/206; 162/207; 162/358; 162/359; 162/375; 100/93 RP
[58] Field of Search ..... 162/206, 207, 205, 359, 162/358, 375; 100/156, 154, 152, 153, 118, 210, 121, 151, 93 RP

[56] References Cited

U.S. PATENT DOCUMENTS 3,880,705 4/1975 Tilburg ..... 162/205 X
4,576,682 3/1986 Laapotti ..... 162/205 X
4,586,983 5/1986 Laapotti ..... 162/205
4,738,752 8/1986 Busker et al. ..... 162/359

OTHER PUBLICATIONS

"Impulse Drying", *The Institute of Paper Chemistry.*

*Primary Examiner*—David Simmons
*Assistant Examiner*—Thi Dang
*Attorney, Agent, or Firm*—Steinberg & Raskin

[57] ABSTRACT

Method for pressing and dewatering a paper web, in which a hot-pressing stage is utilized where the wet paper web is pressed in direct contact with a cylinder face that has been heated to a temperature higher than about 100° C. A relatively long pressing time and a relatively low compression pressure are applied in a pre-heating/pre-pressing stage. In this preliminary stage, a surface layer of the cylinder that heats the paper web is heated to a temperature higher than about 100° C. In the immediately following stage, the compression pressure applied to the paper web is lowered so that vaporization of the water present in the paper web is intensified. Next, the web is passed substantially immediately into an intensive nip-pressing stage in which the web is pressed with a peak pressure, preferably higher by one order, so that water vapor is blown through the paper web, thereby causing some of the water present in intermediate spaces between fibers in the web to be blown out, and intensifying dewatering.

17 Claims, 6 Drawing Sheets

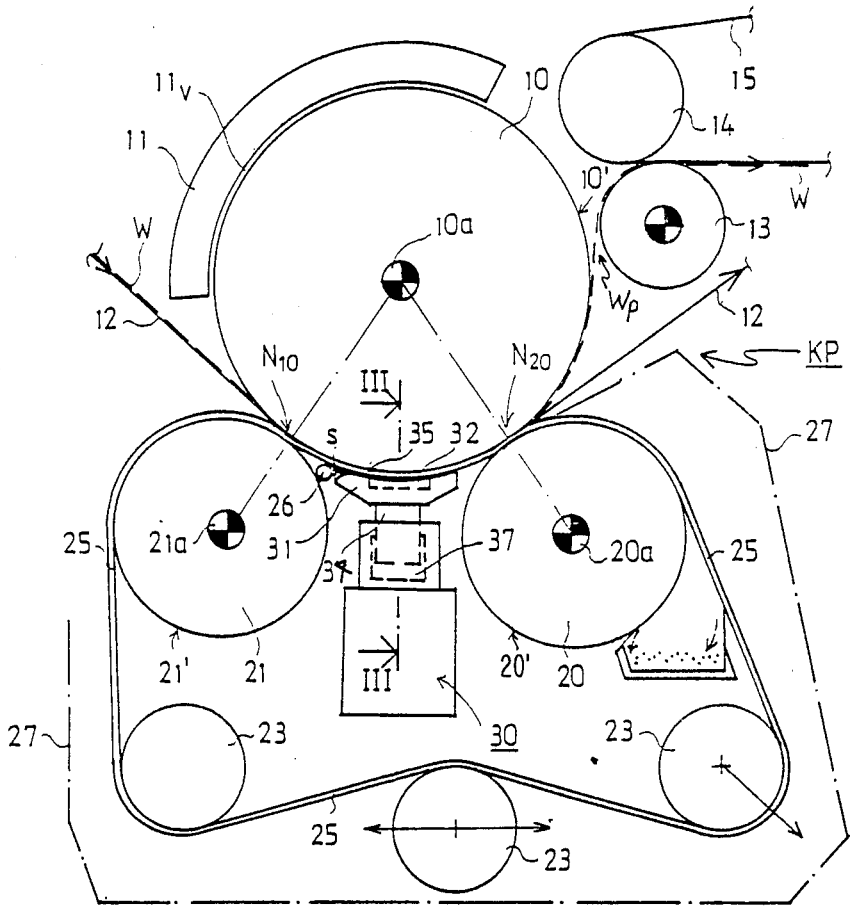
FIG. 2
FIG. 2A
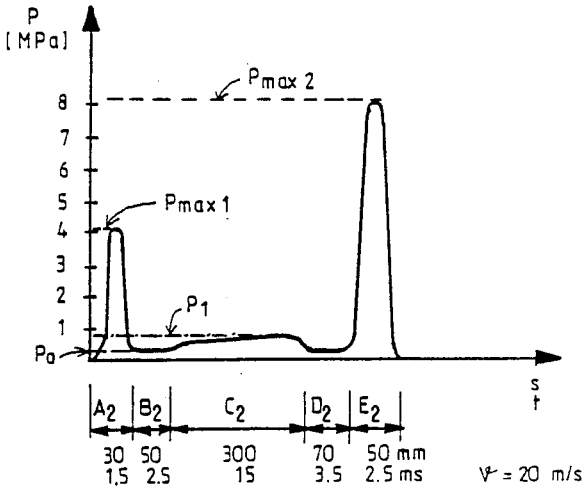

METHOD FOR HOT-PRESSING OF A WEB

BACKGROUND OF THE INVENTION

The present invention concerns a method for pressing a paper web or equivalent and for dewatering the web, in which a hot-pressing stage is utilized where the wet paper web is pressed in direct contact with a cylinder face or a corresponding roll face that has been heated to a temperature higher than 100° C.

The present invention further concerns apparatus intended for carrying out this method, such apparatus comprising a hot cylinder or an equivalent roll which has a smooth heated mantle face which can be heated to a temperature higher than 100° C. before reaching direct contact with the web to be pressed.

The most common prior art mode of dewatering fibrous webs, in particular paper and board webs, is to pass the web through a press nip formed by two rolls situated opposite one another. As is well-known, one or two press fabrics are used in the dewatering nips, which carry the water removed from the web further and act as a fabric carrying the web forwardly.

With increasing production rates of paper machines, the dewatering performed as nip pressing has become a bottle neck that limits increasing of the running speeds. This is due to the fact that the press nips formed by a pair of rolls have a short area, so that with high speeds the residence time of the web in these press nips remains short. However, a certain time is required in order to remove the water from the web into the hollow face of a roll or into the press fabric, especially due to the flow resistance of fiber structure of the web.

In a manner known in the prior art, several press nips placed one after the other have been used, either so-called compact press sections, an example of which is the Valmet "Sym-Press" TM press section, or several separate press nips situated one after the other. Nip presses, however, require relatively large space, especially if separate press nips situated one after the other are used. On the other hand, a compact construction of press sections causes difficulties in the optimal positioning of the different components during replacement of press rolls and press fabrics, as well as, e.g. in the disposal of paper broke during operation.

In nip presses, suction rolls are commonly used which are relatively expensive components and which consume suction energy. In suction rolls, a perforated mantle must be used, which causes problems in the mechanical strength of the suction rolls.

If attempts are made to increase the dewatering capacity in nip presses by increasing the nip pressure, the limit is reached with a certain linear load at which an increased nip pressure is no longer helpful, since the structure of the web no longer endures the compression.

Attempts have been made to extend the compression area in roll nips by using rolls of larger diameter and soft press fabrics, but even with these efforts the limits of economically feasible embodiments are soon reached.

Due to the problems described above and due to other reasons, so-called extended-nip presses have been developed in recent years. In this respect, reference is made by way of example to U.S. Pat. Nos. 3,783,097; 3,808,092; 3,808,096; 3,840,429; 3,970,515; 4,201,624; and 4,229,253, as well as to the Valmet Finnish Pat. Nos. 65,104; 70,952; and 71,369.

It has been known to use steam boxes or equivalent heating devices in connection with the press section in the prior art, by which the temperature of the water contained in the web to be pressed and of the fiber structure is raised so as to alter the viscosity of the water and the elastic properties of the web in such a manner that the dewatering is intensified. By means of these heating devices, the dry solids content of the web after the press section can be increased by only a few percentage points.

So-called hot-pressing methods are also known in the prior art, in which respect reference is made by way of example to U.S. Pat. No. 4,324,613, according to which the paper web is pressed in a roll nip in which one of the rolls or cylinders has been heated by means of surface heating to a temperature higher than 100° C. In this nip, the surface water in the paper web can be vaporized and the pressurized vapor blows water which has been pressed into the intermediate spaces in the fiber structure into the paper, into the press felt. The dry solids content achieved by means of this prior art hot-pressing method is quite good, but there is a problem of the short nip time in a high-speed machine, because the compression time in a roll nip is only about 1 to 3 ms, so that the vaporization does not have enough time to be started properly unless the roll temperature is extremely high (on the order of 500° C.). The high temperature of the roll results in problems, in particular with respect to the strength of the press fabric and of the roll.

With respect to the prior-art hot-pressing methods, reference is further made to the paper *The Institute of Paper Chemistry,* "Impulse Drying". In the method described in this paper "Impulse Drying", attempts have been made to eliminate the problem of the noted U.S. Pat. No. 4,324,613, i.e. The short nip time, so that instead of a roll nip, an extended nip is used which is formed by a heated roll or cylinder and a so-called extended-nip shoe. Thus, considerably more time is allowed for the vaporization of the water in the surface of the paper web as compared with the roll nip construction of the noted U.S. Pat. No. 4,324,613. However, a problem that remains is the high compression pressure (60–120 bar) that is required, in particular with thin paper qualities. This high compression pressure causes problems of lubrication of the glide shoe and the glide belt in the extended nip, such problems being further increased by the high temperature.

With respect to the prior art related to the hot-pressing technique, reference is further made to the Finnish Patent Application No. 853273 (corresponding to the International Pat. Appl. PCT/SE No. 85/00009, priority SE No. 84 00256-7, Jan. 19, 1984). In the method suggested in this cited publication, the paper web is pressed in a roll nip so that the press fabric is heated from outside the nip by means of heating devices. In the nip, water is compressed out of the paper web in the direction of this heated fabric. The allegedly good dry solids content is probably achieved, among other factors, in that a layer of vapor is thereby formed between the hot press fabric and the paper to be pressed, said vapor layer allegedly efficiently preventing rewetting of the paper. Problems of the method include, among other factors, both the production of a heat-resistant press fabric and the short nip time. On the whole, this method does not appear convincing and operable, at least not in its present stage of development.

Prior art related to the present invention further includes the so-called normal hot-pressing, which was preliminarily mentioned above and which is carried by using, e.g., a steam box for additional heating of the paper web. This mode of pressing is very common, e.g. in the Valmet Sym-Press II TM press section. However, in this method the temperature of the paper web always remains below 100° C. so that no "blowing-through" of pressurized vapor or a corresponding pressing result is produced in the nip.

A "displacement pressing" method is also known in the prior art, in which pressurized air or steam is pressed through the paper web during the pressing stage, and water which has been pressed into the fiber structure can be removed from the fiber structure of the paper web. This method does not belong to the hot-pressing methods per se. Suggestions of equipment suitable for production machines for this method have not been made. A difficulty is arranging the blowing-through in the pressing zone.

SUMMARY OF THE INVENTION

Accordingly, it is an object of the present invention to further improve over the prior-art hot-pressing methods so that the draw backs which occur as noted above and limit the use thereof can be avoided or at least reduced.

It is an additional object of the present invention to specifically intensify dewatering of a web in a press section of a paper machine.

It is another object of the present invention is to provide a hot-pressing method by which the dry solids content after the press section can be made higher than about 50% and under favorable conditions up to about 60–70%. By means of this increase in the dry solids content, it is possible to substantially increase the energy efficiency of paper manufacture, for as is well known the energy efficiency of dewatering by means of pressing is up to seven times higher than in removal of water taking place by means of evaporation.

It is a further object of the present invention is to provide a method and a device in which the supply of energy to the web can also be distributed to other locations, besides the heating cylinder or cylinders.

These and other objects are attained by the present invention which is directed to a method for pressing and dewatering a web, comprising the steps of bringing the wet web into direct contact with a cylinder or roll face that has been heated to a temperature higher than about 100° C., pre-heating and pre-pressing the web against the cylinder or roll face for a relatively long pressing time and at a relatively low compression pressure, lowering the compression pressure so that vaporization of moisture present in the web is intensified, and substantially immediately intensifying the pressure to a peak value that is substantially higher than the pressure applied in the preceding step, so that vapor is blown through the web and thereby causes some of the moisture present in intermediate spaces between fibers in the web to be blown out, thus intensifying the dewatering. The pressure is intensified to a peak value approximately one order higher than the pressure applied in the preceding step.

The present invention is also directed to apparatus for pressing and dewatering a web, which comprises the combination of a cylinder or roll having a smooth mantle face which is heatable to a temperature higher than about 100° C. before reaching direct contact with the web, a press roll about which a glide belt is guided and tensioned and arranged to form a roll press nip with the heated face of the cylinder/roll, a press shoe arranged before the roll nip in a direction of travel of the web, and forming an extended press zone with the face of the cylinder/roll substantially immediately before the roll press nip, and a water-receiving press fabric arranged to pass through the extended nip and roll nip between the web and the press glide belt.

With a view to achieving the objectives that have been noted above and those which will become apparent below, the method in accordance with the present invention is principally characterized by comprising the following steps to be carried out in the sequence given below:

(a) a preheating-pressing stage in which a relatively long pressing time and a relatively low compression pressure are used, and in which the surface layer of the cylinder/roll that heats the paper web is heated to a temperature higher than about 100° C.;

(b) a stage following the above-noted pre-heating/-pressing stage, in which the compression pressure applied to the paper web is lowered so that the vaporization of the water present in the paper web is intensified; and (c) a stage following after the above-noted pressure lowering stage in which the web is passed substantially immediately to an intensive nip pressing stage or equivalent where the paper web is pressed with a peak pressure substantially higher than the pressure applied in the preceding stage, preferably by one order higher, so that water vapor is blown through the paper web, thereby causing some of the water present in the intermediate spaces between the fibers in the web to be blown out and, thus intensifying the dewatering.

Apparatus in accordance with the present invention is principally characterized by comprising a combination of a press roll, around which a press-glide belt is guided by guide and tensioning rolls, which is provided and is arranged to form a roll press nip with the heated face of the hot cylinder;

a press shoe device arranged before the roll press nip, in which the nip press shoe forms an extended press zone with the face of the hot cylinder substantially immediately before the roll press nip; and a press fabric that receives water, which is passed through the extended nip and through the roll nip and which is passed between the web to be pressed and the press-glide belt through the press zones.

By means of the method and apparatus in accordance with the present invention, efficient dewatering is above all achieved because due to the long pre-pressing stage, a sufficient time is allowed for the vaporization of the water in the surface of the paper web. This time is, as a rule, about 5 to 50 ms, most appropriately about 10 to 30 ms depending on the dimensioning of the press shoe.

In the present invention, the vaporization of the water is intensified by means of a low-pressure intermediate zone, and the pressing to the ultimate dry solids content is performed in a high-pressure roll nip in which blowing-through also occurs for the removal of the water present between the fibers. Thus, by means of the method and the apparatus of the present invention, a relatively high dry solids content is attained, as a rule within the range of about 50 to 70%.

The problems occurring in the prior art devices are eliminated by means of the present invention, primarily as follows. In the present invention, the problem of the heating time of the paper web surface has been resolved by means of an extended-nip shoe construction of relatively low pressure. The problem of lubrication of the glide shoe is eliminated in the present invention, because a relatively low compression pressure is sufficient. The problem of splashing of the lubricant can, if necessary, being reduced by means of water lubrication. Due to the present invention, a very high compression pressure is not required, because the dewatering nip proper is a roll nip which permits a high compression pressure and which may, if required, even be extended, with the compression impulse being increasable by means of a so-called resilient belt or by means of a press roll coated with resilient material.

According to an advantageous embodiment of the present invention, the preheating-pressing stage is arranged so that blowing of water vapor therein through the web takes place, by means of which water pressed into the intermediate spaces between the fibers in the web is blown out into the press fabric. In other words, the preheating-pressing stage or stages is/are arranged in such a way that blowing of water vapor through the web takes place therein, whereby blow-off of water pressed into the intermediate spaces between the fibers in the web is achieved, into the press fabric. More water is thus pressed out of the paper web into the press felt or fabric. Water vapor blowing through the paper web causes blowing off of water pressed into the intermediate spaces between the fibers in the web itself.

In the apparatus in accordance with an advantageous embodiment of the present invention, several paper-web heating devices are used before the hot-pressing stage of the invention herein, so that the dry solids content of the paper web can be made as high as possible, and its temperature as high as possible. The heating devices used before the hot-pressing stage proper are, e.g., steam boxes, infrared heaters, and/or high-frequency heaters. It is not always necessary to use all of these preheating devices at the same time.

BRIEF DESCRIPTION OF THE DRAWINGS

The present invention will be described in greater detail below with reference to certain exemplary embodiments thereof illustrated in the accompanying figures, to which the present invention is not intended to be confined. In the drawings.

FIG. 2 is a view similar to FIG. 1, of a variation involving two roll nips and an extended nip placed therebetween;

FIG. 2A illustrates distribution of the compression pressure in the apparatus illustrated in FIG. 2;

DESCRIPTION OF THE PREFERRED EMBODIMENTS

Figure 1:
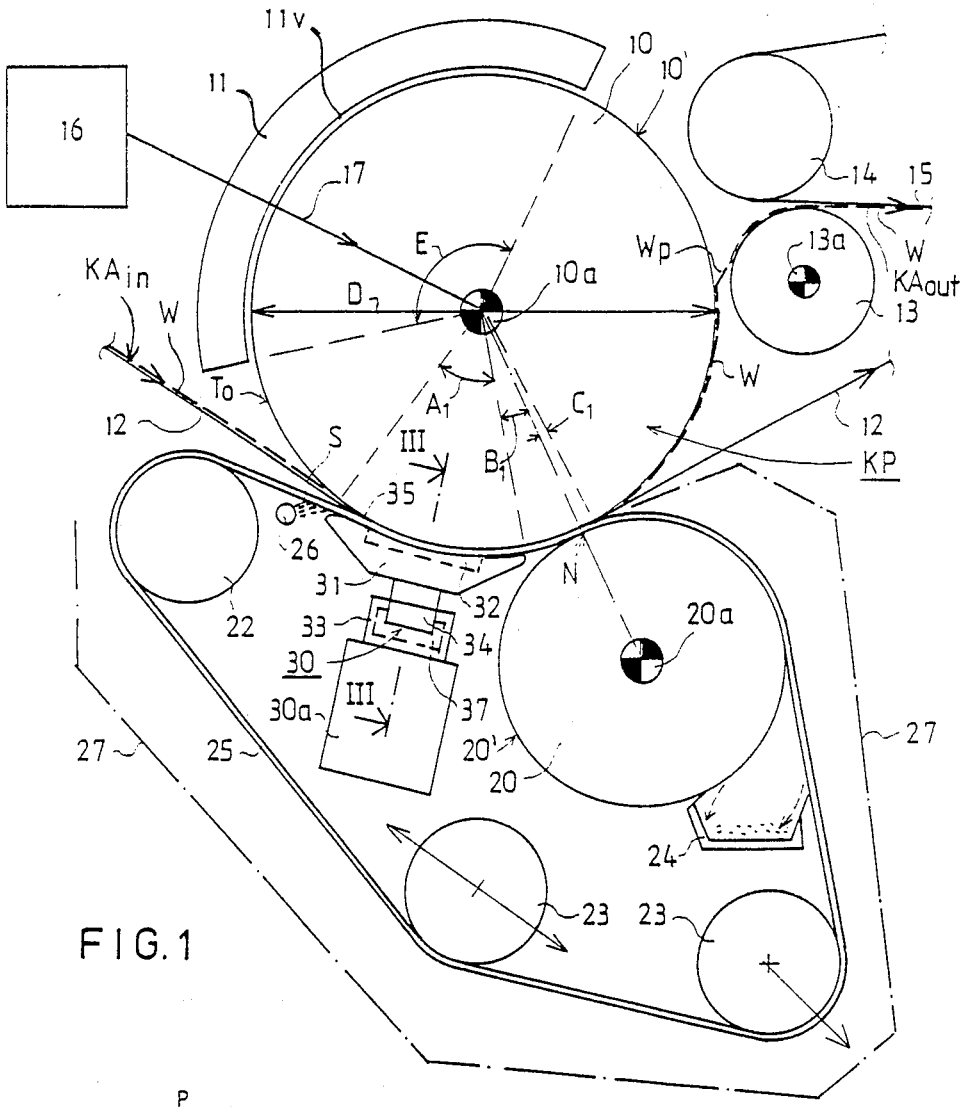
FIG. 1 is a schematic sectional view of a hot-pressing apparatus in accordance with the present invention.

The hot-pressing device KP in accordance with the present invention comprises a heated roll or cylinder 10 of relatively large diameter D, having a smooth outer face 10' and being provided with a drive **10*a*. The face of the cylinder or roll 10 is heated from inside and/or from outside by means of steam, flame heating, by means of various radiation such as infrared radiation and microwave heating, or by means of induction heating devices based upon eddy currents. FIGS. 1 and 2 are schematic illustrations including an induction heating device, a flame heating device or an infrared heating device 11 which heats the cylinder 10 face 10' free of contact through an air gap 11*v* within a sector E having a magnitude preferably larger than about 90°. In FIG. 1, the steam supply devices 16 are also shown schematically, by means of which pressurized steam can be passed through a steam connector situated at the end of the cylinder 10, into the cylinder 10 through the duct 17** via steam pipes, e.g. in accordance with the same principle as in drying cylinders, known in and of themselves, which are used in the drying section.

The temperature $T_0$ of the cylinder 10 face 10' is controlled so that it is $T_0$>about 100° C. when the face 10' meets the web W which is being conveyed to the hot pressing on a face of a press felt 12, dry solids content of the web being denoted by $KA_{in}$. Depending upon the location of the hot-pressing device in accordance with the present invention, the $KA_{in}$ varies within the range of $KA_{in}$=about 15 to 55%.

Figure 5:
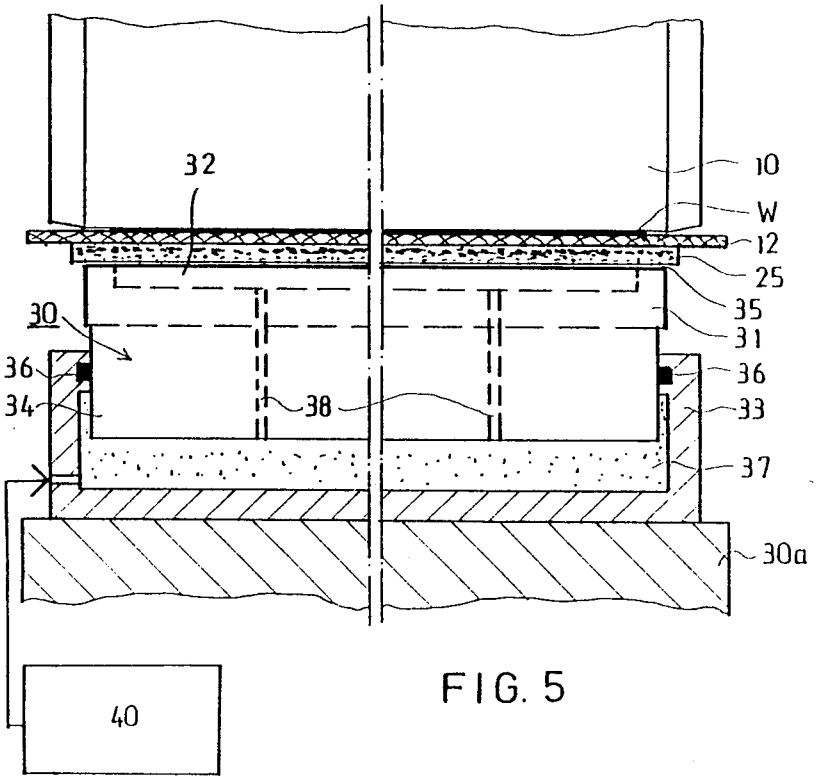
FIG. 5 illustrates a sectional view along line V—V in FIG. 4.

A press-shoe device 30 in the hot-pressing section KP comprises an extended-nip press shoe 31 in which there is a hydrostatic pressure chamber 32 situated against an impervious glide belt 25. The press shoe device 30 comprises a frame beam **30*a* which extends over the entire width of the paper web W as seen in FIG. 5. A cylinder block 33 is provided on the frame beam 30*a*, with pressure or pressures of a pressure medium being passed from a pressure source into the pressure space 37 thereof. The pressure source is schematically denoted in FIG. 5 by the block 40. There is a piston 34 provided with seals in the cylinder block 33 and with a glide face 35 acting against an inner face of the glide belt 25 within the extended-nip zone A. Pressurized lubricant is passed from the pressure space 37 through bores 38 and into the hydrostatic pressure chamber 32**.

If necessary, the lubrication for the inner face of the glide belt 25 can be intensified by spraying jets S of lubricant into the inlet side of the extended-nip zone A by means of devices 26. The lubricant may be, e.g., water or oil or an emulsion of the same. The extended-nip press shoe 31 is a hydrostatic shoe, a hydrodynamic shoe, or also a combination of the same. With respect to details of construction of the extended-nip press, references made by way of example to the previous Valmet Finnish Pat. Nos. 65,104; 70,952; and 71,369.

The rib-shaped piston 34 of the shoe device 30 is arranged pressure-tight in the cylinder space 37 by means of seals 36. Instead of one single piston 34 and glide shoe 31, it is possible to use a cylinder-piston series fitted, e.g., in bores within the cylinder block 33, with an adjustable pressure being passed into the individual cylinders in the series so that the transverse distribution of the compression pressure can be controlled, e.g. by means of devices and adjusting methods of the sort described in the Valmet Finnish Patent Application No. 864,564. In other words, the axial temperature profile of the face of the hot cylinder 10 may be arranged to be adjustable by means of the heating device 11, and/or the axial distribution of pressure in the roll nip N or in roll nips $N_{10}$, $N_{12}$, may be arranged to be adjustable, e.g., by means of variable-crown rolls, and/or axial distribution of pressure at the extended-nip press shoe 31 may be arranged adjustable, preferably by means of the cylinder-piston series that can be loaded by means of a pressure medium, for the purpose of adjusting and controlling transverse profile of properties of the paper web W.

Figure 7:
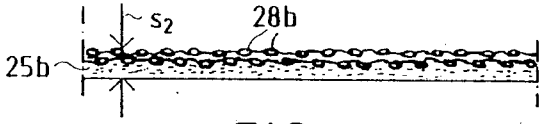
Figure 8:
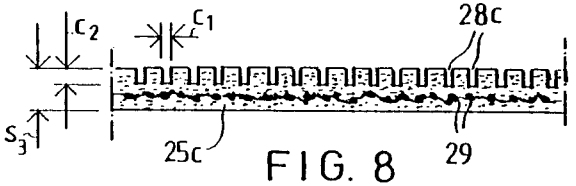
Figure 9:
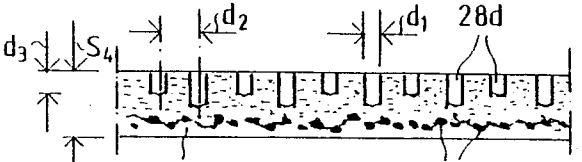

In accordance with FIG. 1, the impervious glide belt 25 is guided by guide roll 22, press roll 20, and by tensioning rolls 23. A splash-water collecting trough 27 is provided around the loop of the glide belt 25, which is required, in particular, when a hollow-faced **28*b*, 28*c*, 28*d* glide belt shown in FIGS. 7, 8 and 9 is used. The press roll 20 is provided with a smooth face 20' and with a drive 20*a*, with a lubricant collecting trough 24** being situated at a rear side thereof from which lubricant is fed by means of a recirculation device (not illustrated) for further use.

The heated cylinder 10 and the press roll 20 form a nip N between the same, after which the web W is detached from the press felt 12 which is passed to reconditioning. Afterwards, the web W follows along with the smooth face 10' of the cylinder 10, from which it is detached as a draw $W_p$ by means of a paper guide roll 13 provided with a drive **13*a* and is transferred onto support of a drying fabric 15 guided by the guide roll 14. Fabric 15** passes the web W to the drying section, where the dewatering is continued by means of evaporation. The dry solids content of the web W after the hot-pressing device KP is denoted by $KA_{out}$. As a rule, the dry solids content $KA_{out}$=about 50–70%.

The hot-pressing device KP illustrated in FIG. 2 differs from the device illustrated in FIG. 1 in the respect that, in connection with the heated cylinder 10, two nips $N_{10}$ and $N_{20}$ are formed, between which there is a press-shoe device 30 and an extended-nip press shoe 31. In other respects, the construction is similar to that shown in FIG. 1.

The first embodiment of a method in accordance with the present invention will be described below, with reference to FIGS. 1 and 1A. The paper web W is pressed by means of an extended-nip press shoe 31 of relatively low pressure ($p_1$) through the belt 25 and the press felt 12, against the hot ($T_0 > 100°$ C.) cylinder 10 face 10', thereby producing heating of the face of the paper web W that is placed in contact with the face 10', to a temperature higher than 100° C. This temperature of the face 10' when it reaches contact with the web W is within the range of $T_0$=about 105°–500° C. The corresponding temperature $T_{01}$ at the time when the web departs from the face 10' is, as a rule, within the range of $T_{01}$=about 100°–300° C.

The pressure level of the extended-nip press shoe 31 is, e.g., $p_1$ roughly equal to about 0.1–5 MPa, in which case it is possible to use, e.g., water or a water-oil emulsion as the lubricant fed in the form of jets S by means of the devices 26. A higher pressure would require the use of lubrication oil, scraping off, and oil mist, which result in the drawbacks noted above. The extended-nip shoe is hydrostatic, hydrodynamic, or a combination thereof.

After the extended-nip pressing stage $A_1$, the pressure applied to the paper web (W) is lowered to the level $p_0$ determined by tensioning the belt 25 within the zone $B_1$, and the vaporization of the water in the paper web W is intensified as a result of the lowering of the pressure $p_1$ to $p_0$. The pressure $p_0 = T/R$, where T=tightening tension of the belt 25 and R=radius of the cylinder 10=D/2, i.e. the counter cylinder. The zone $B_1$ is followed by a stage of intensive pressing taking place in the nip N, in which the paper web is pressed with a high pressure between the cylinder 10 or a corresponding roll and the press roll 20. In FIG. 1A, this particular stage is denoted by $C_1$, with the maximum level of compression pressure being $p_{max}$ roughly equal to about 8 MPa. In the compression stage $C_1$, the water vapor is blown through the paper web W and produces blowing-off of water contained in intermediate spaces between fibers in the web, and thereby an intensified pressing result and a higher dry solids content $KA_{out}$.

Since the compression pressure increases from the intermediate pressure $p_0$ to the maximum pressure $p_{max}$ very rapidly, and the colder water pressed from the paper web W from the portion situated next to the face of the glide belt 25 reaches contact with water vapor, a collapse of the vapor bubbles, namely a so-called cavitation and/or implosion takes place, and due to the same the dewatering is intensified further.

It is also possible to use a so-called resilient belt as the glide belt 25, by means of which the zone $C_1$ in the roll nip and at the same time the press time can be made longer, with the compression impulse being increased. In other words, a resilient belt may be passed through the extended-nip pressing stage $A_1$, $C_2$ and possibly through a preceding nip-pressing stage $A_2$ if any, by means of which the pressing time in the roll nip N or in the nips $N_{10}$, $N_{20}$ are extended and if necessary, the compression pulse is increased. If necessary, it is also possible to use a separate resilient band which is passed to run between the glide belt 25 and felt 12. Since water cannot be pressed out of the press felt 12 into the hollow faces on the rolls, it is possible to provide the belt 25 with a hollow face, in which respect reference is made to FIGS. 7, 8 and 9.

With respect to the provision of equipment, the embodiment of the invention illustrated in FIGS. 2 and 2A differs from the embodiment illustrated in FIG. 1, in that the device additionally includes a press roll 21 situated before the press shoe device 30, this roll 21 having a smooth mantle face 21' and being provided with a drive **21*a*. The press roll 21 is placed inside the loop of the glide belt 25 and forms a nip $N_{10}$ with the hot cylinder 10. The web W is passed on the support of the press belt 12 directly into the nip $N_{10}$ so that the web W becomes situated directly against the heated smooth face 10' of the cylinder 10. In a corresponding manner, the press felt 12 is detached after the second nip $N_{20}$ from the web W which follows along with the smooth face 10' of the cylinder 10, from which it is detached as an open draw $W_p$. In other words, the first stage $A_2$ is a first preheating-pressing stage which is carried out in the first roll nip $N_{10}$ between the heating cylinder 10 and the press roll 21**, and which is followed by a pressure-lowering stage $B_2$, and, in accordance with the present invention, by a preheating-pressing stage $C_2$, a pressure-lowering and vapor-formation stage $D_2$, and by an intensive nip-pressing and blowing-through stage $E_2$ proper, as noted in FIG. 2A.

Figure 3:
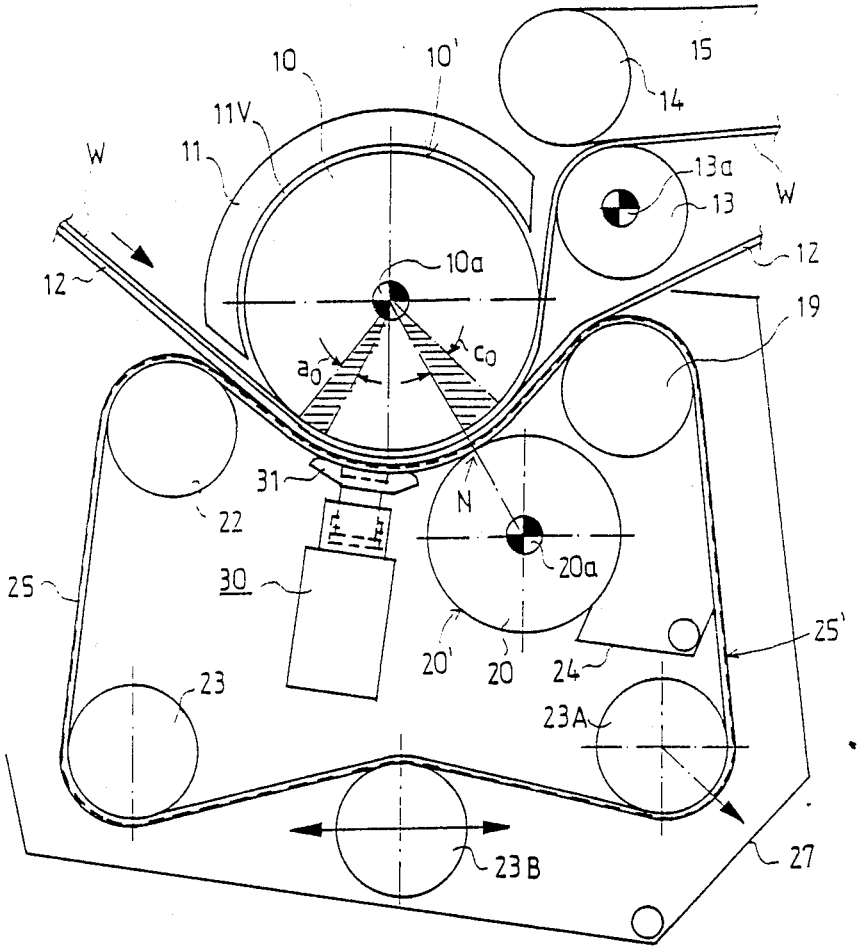
FIG. 3 illustrates a modification of the embodiment of the invention shown in FIG. 1, in which a sector of contact between the heating cylinder and web has been extended both before and after the hot-pressing stages.
Figure 3A:
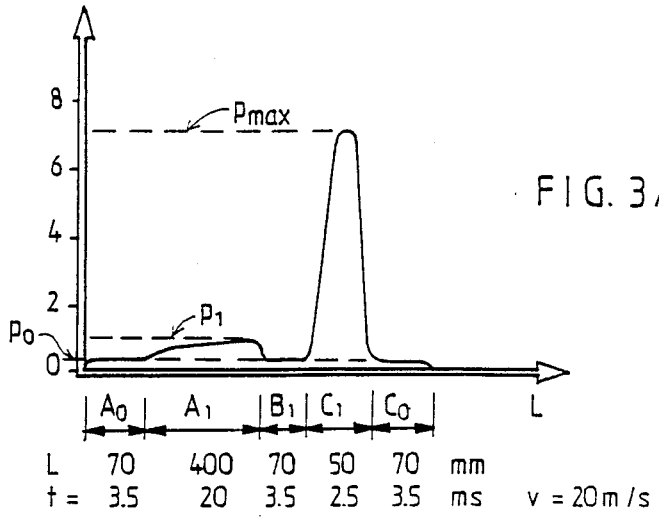
FIG. 3A illustrates the distribution of the compression pressure in the apparatus illustrated in FIG. 3.

A modification of the apparatus illustrated in FIG. 1 is shown in FIGS. 3 and 3A, in which the belt 25 and the web W which enters into the nip formed by the press shoe 31 and the cylinder 10 along with the belt 25 and while carried by the felt 12, are passed within a sector $a_0$ of the cylinder 10 into a pre-heating/pre-pressing stage which is denoted as the zone $A_0$ in FIG. 3A before the extended-nip pressing stage $A_1$ and in which the prevailing compression pressure is $p_0=T/R$ wherein T is the tightening tension of the belt 25 and R is the radius of the cylinder 10. In other words, the press-glide belt 25, which is preferably provided with a hollow face 25', is guided by means of guide rolls 22, 19 to contact the face 10' of the hot cylinder 10 so that before the press-glide shoe 31 or the press roll 21, the web W is pressed by means of the tightening tension T of the press-glide belt 25 over a certain sector $a_0$ of the hot cylinder 10 against the cylinder face 10'. In a corresponding manner, after the nip N between the roll 20 and the cylinder 10, there is an after-pressing stage (pressure being the above-noted $p_0$) within a sector $c_0$ of the cylinder, said stage being denoted by $C_0$ in FIG. 3A. In other words, after the hot-pressing stages proper, there is an after-pressing stage $C_0$, $E_0$ in which the web W is pressed after the preceding nip-pressing stage $C_1$,E with a compression pressure $p_0$ produced by means of the tension T of the press belt 25, and after which the web W is detached from the press felt 12 and passed forwardly.

Figure 4:
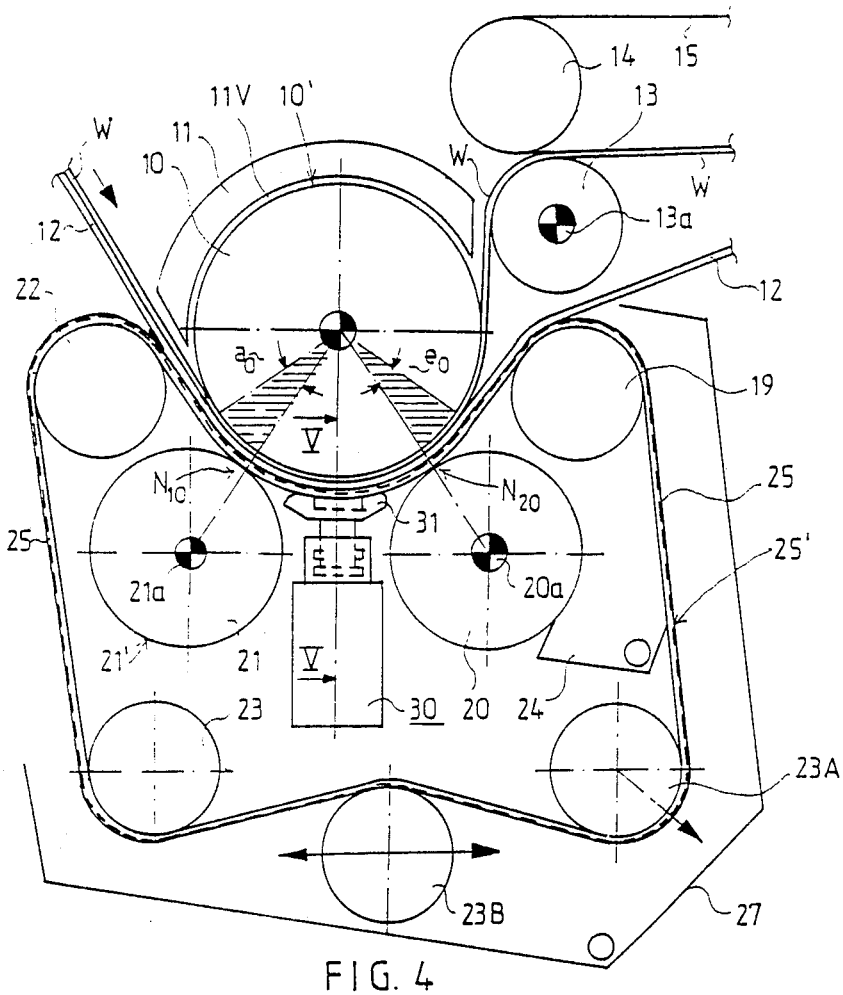
FIG. 4 illustrates a modification of the apparatus shown in FIG. 2, in which the sector of contact between the heating cylinder and the web has been extended both before and after the hot-pressing stages.
Figure 4A:
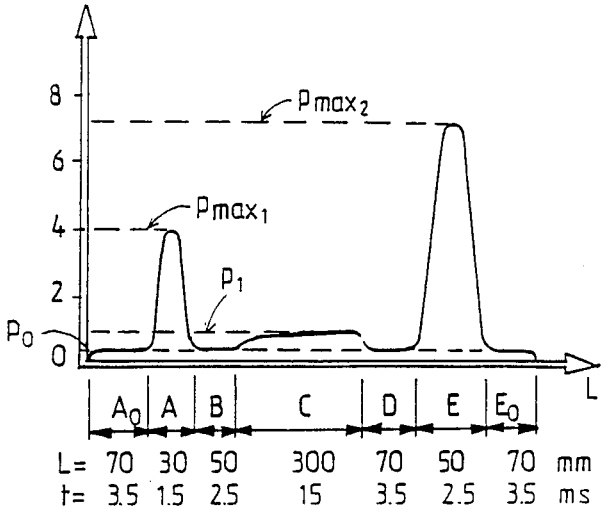

FIGS. 4 and 4A illustrate a modification of the hot-pressing apparatus illustrated in FIG. 2, in which the guide roll 22 of the band 25 is located so that there is a pre-heating/pre-pressing stage within the cylinder 10 sector $a_0$ before the nip $N_{10}$, in which the prevailing pressure is the above pre-pressing pressure generated by the tightening tension T of the band 25. This pressure is denoted in FIG. 4A by $p_0$, and the corresponding pressing zone by $A_0$. In a corresponding manner, there is an after-pressing stage after the latter nip $N_0$ and within the cylinder 10 sector $e_0$, in which the pressure $p_0$ prevails which is generated by the tightening tension of the band 25 and which is effective in accordance with FIG. 4A within the zone $E_0$.

The time of contact between the web W and the heating cylinder can be increased with the sectors $a_0$, $c_0$, and $e_0$ illustrated in FIGS. 3 and 4, and with the corresponding zones $A_0$, $C_0$, and, $E_0$, while the overall time taken by the performance of the pressing stages can be increased with a view to obtaining a higher dry solids content $KA_{out}$ of the web.

Figure 1A:
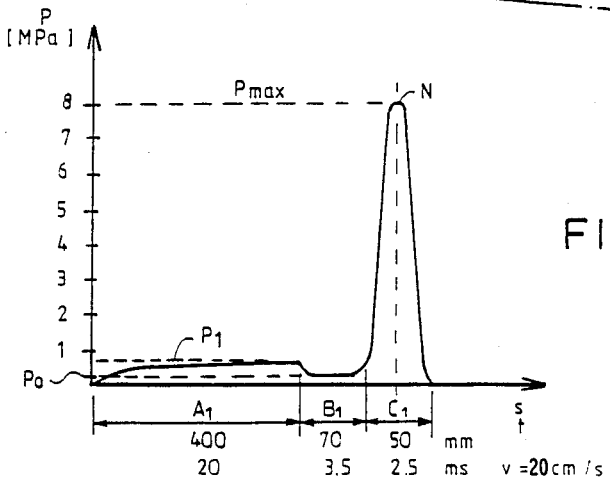
FIG. 1A illustrates the distribution of the compression pressure realized in the apparatus of FIG. 1.

In FIG. 3A, the above stage $A_0$ has been added as compared to the steps shown in FIG. 1A, which can be called a pre-heating/pre-pressing stage because the compression pressure $p_0$ prevailing therein is quite low and is produced exclusively by the tightening tension T of the belt 25. Correspondingly, as compared to FIG. 1A there is an after-pressing stage $C_0$ after the stage $C_1$ in FIG. 3A, in which the low compression pressure $p_0$ prevails.

In FIG. 4A, as compared to FIG. 2A, there is a pre-heating/pre-pressing stage $A_0$ before the stage A, in which the low compression pressure $p_0$ prevails and correspondingly, there is an after-pressing stage $E_0$ in which the above-noted low compression pressure $p_0$ prevails after the compression stage E in the nip $N_{20}$.

Figure 6:
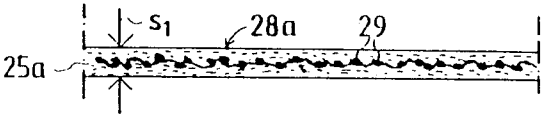
FIGS. 6, 7, 8 and 9 illustrates certain alternative embodiments of a press belt for use in accordance with the present invention.

FIG. 6 illustrates a smooth surface **28*a* glide belt 25*a* suitable for use in the present invention and having a thickness $s_1$=about 3 to 15 mm. The belt 25*a* may be, e.g., made of polyurethane or of polyimide which has a higher resistance to heat, the hardness being preferably within the range of about 10 to 100 P&J. If necessary, a reinforcement fabric and/or a fiber reinforcement 29 may be used in the belt 25*a***.

Examples of hollow-faced belts are illustrated in FIGS. 7, 8, and 9, in which the hollow-face is designed to be placed in contact with the press felt 12 and has the function of transferring water from the felt 12 to outside of the compression zone.

FIG. 7 illustrates a belt **25*b* having an average thickness $s_2$ preferably equal to about 3 to 15 mm. The side of the belt that becomes situated in contact with the felt 12 has a hollow face of a fabric 28*b* with a coarse structure. The fabric 28*b* is, e.g., made of polyester, while the rest of the belt 25*b*** may be constructed of polyurethane or polyimide having a hardness within the range of about 10 to 100 P&J.

FIG. 8 illustrates a belt provided with a grooved hollow face **28*c* and with a reinforcement network 29. The hollow face 28*c* is provided with longitudinal grooves in the machine direction, groove width being preferably $c_1$=about 0.4 to 1 mm, and the groove depth $c_2$=about 1 to 4 mm, with the thickness of the belt 25*c* $s_3$=about 5–20 mm, and the hardness of the frame layer which is provided with a reinforcement fabric 29** and which is made, e.g., of polyurethane or polyimide being about 10 to 60 P&J.

FIG. 9 illustrates a hollow-faced **28*d* glide belt 29*d* having a hollow face 28*d* of blind-drilled bores. Preferably, the bore diameter is $d_1$=about 1.5–4 mm and $d_2$=about 5–25 mm, with the bore depth $d_3$=about 1.5–10 mm and the belt 25*d* thickness $s_4$=about 6 to 25 mm. The belt 25*d* is provided with a reinforcement fabric 29 and its frame portion is made, e.g., of polyurethane or polyimide having a hardness within the range of about 10 to 100 P&J. As was stated above, the hollow faces 28*b*, 28*c*, and 28*d* become situated against the press felt 12, while the opposite smooth and slippery faces of the belts 25 are placed against the press shoe 31**.

Examples are given in FIGS. 1A, 2A, 3A and 4A on the middle line below the zones denoted A to E, of advantageous lengths (mm) of the zones, and on the bottom lines of the corresponding residence times (ms) with a machine speed of v=20 m/s.

The stage $A_1$ in FIGS. 1 and 1A may be called a pre-heating/pre-pressing stage, while the stage $B_1$ due to the lowering of the pressure, is the vapor formation stage, and the stage $C_1$ being the (intensive) pressing and blowing through stage proper.

In FIGS. 2 and 2A, the corresponding stages may be denoted as follows. Stage A in which a peak compression pressure $p_{max1}$ is used in the nip $N_{10}$, is a first pre-heating/pre-pressing stage, while the stage B is a pressure-lowering stage, the stage C is a second pre-heating/pre-pressing stage, the stage D is a pressure-lowering and vapor formation stage, and the stage E is an (intensive) pressing and blowing-through stage proper.

Figure 10:
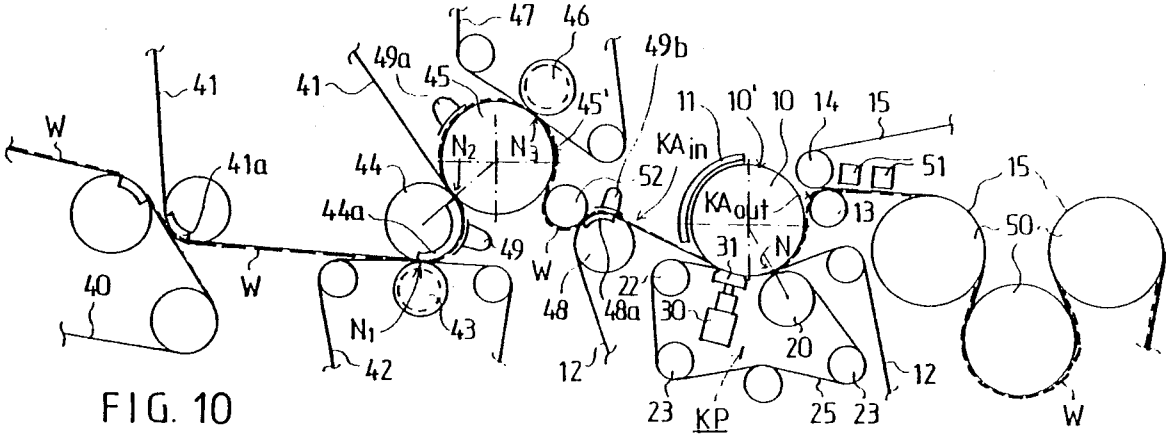
FIG. 10 illustrates a first exemplary embodiment of positioning of a hot-pressing apparatus in accordance with the present invention, in conjunction with the Valmet Sym-Press TM press section.
Figure 11:
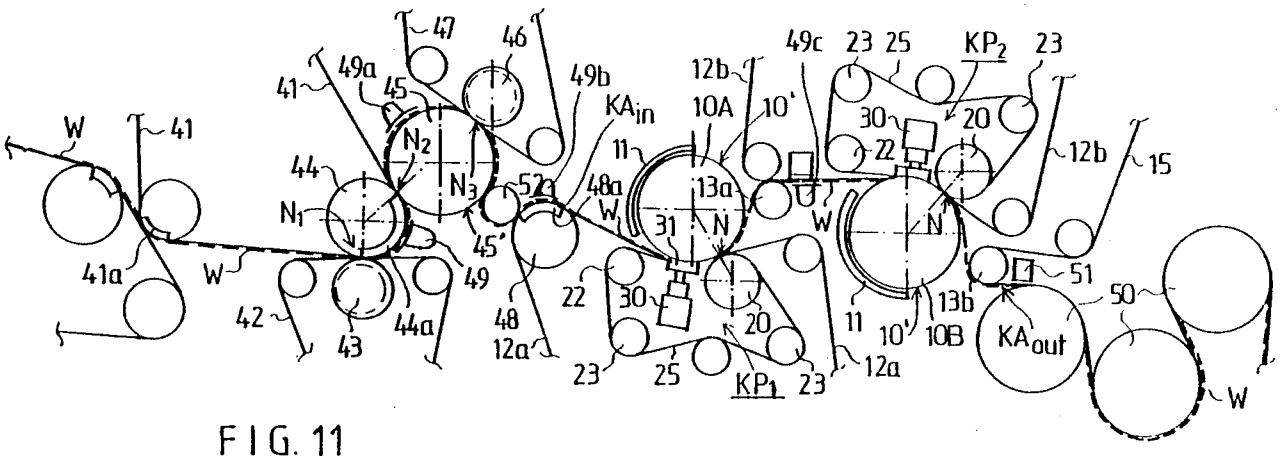
FIG. 11 illustrates an embodiment of the invention in which two hot-pressing apparatus in accordance with the present invention are used in the press section, one after the other.

FIGS. 10 and 11 illustrate two advantageous embodiments of the present invention in combination with the Valmet Sym-Press II TM press section, with the same reference numerals denoting the same or similar components. The web W is formed on a forming wire 40, and transferred onto a felt 41 over a suction zone 41*a* of a pick-up roll. The web W is transferred further by the support of the felt 41 through the first nip $N_1$, which is formed between a press roll 43 and a suction roll 44. A lower press felt 42 runs through the nip $N_1$.

In order for the dry solids content and the temperature of the paper web to be made as high as possible, even before the hot-pressing devices KP or KP1 and KP2, it is advantageous to use several pre-heating devices for the paper web, which are illustrated in FIGS. 10 and 11 as a heating device 49 acting against the suction sector 44*a* of the suction roll 44, a heating device 49*a* placed against a center roll 45 of the press section, a heating device 49*b* acting against a suction sector 48*a* of a transfer-suction roll 48, and a heating device 49*c* situated before the hot-pressing device KP2. The above paper-web heating devices 49, 49*a*, 49*b* and 49*b* are, for example, steam boxes, infrared heaters or high-frequency heaters. It is not necessary to use all of these different heating devices at the same time.

The second nip $N_2$ is formed between a suction roll 44 and the smooth-faced center roll 45. The web W adheres to a smooth face 45, of the center roll 45 and moves along this face into a third nip $N_3$ which is formed between the center roll 45 and a hollow-faced roll 46. A press felt 47 runs through a third nip $N_3$.

As is shown in FIG. 10, the web W is transferred on a paper guide roll 52 onto a suction-transfer roll 48, with the web W being made to adhere to a press felt 12 over a suction zone 48*a* thereof. The web W is passed by support on the felt 12 through the hot-pressing stage in accordance with the present invention, which is a single stage in FIG. 10.

As is shown in FIG. 11, two subsequent hot-pressing stages $KP_1$ and $KP_2$ in accordance with the present invention are provided, in which the web is passed from the paper guide roll 52 onto a first felt 12*a* and with the support thereby through the first hot-pressing stage $KP_1$, further as guided by a paper guide roll 13*a* from a first hot-pressing cylinder 10A onto a second felt 12*b* and then with the support thereby over a second hot-pressing cylinder 10B and through a second hot-pressing stage $KP_2$, and then further as guided by a guide roll 13*b* onto a drying wire 15 to which the web W is made to adhere by means of suction boxes 51. The web W is then passed on the drying wire 15 over cylinders 50 in the drying section.

In the method of the present invention, the dry solids content of the web that is being passed into the treatment in accordance with the present invention (i.e. The wet web) is within the range of $KA_{in}$=about 15–55%. After the treatment which may be carried out in a single stage KP, or in two stages $KP_1$, $KP_2$, the dry solids content $KA_{out}$ of the web is within the range of $KA_{out}$=about 50–70%.

When two subsequent hot-pressing stages and devices $KP_1$ and $KP_2$ are used in accordance with FIG. 11, a high dry solids content $KA_{out}$ is obtained which is of an order of about 65 to 70%. Moreover, the advantage is obtained that, by using two subsequent sets of equipment inverted relative to one another, in the manner illustrated in FIG. 11, the web W can be pressed with both of its sides against the smooth faces 10, of the hot cylinders 10A and 10B. In this manner, the structure of the web W can be made very symmetrical and equal at both sides thereof, which is an important quality especially in the case of printing papers.

Due to the intensified dewatering by means of the method of the present invention which can be accomplished as a single stage or as several stages, a higher dry solids content $KA_{out}$ at the outlet of the press section is achieved, this dry solids content being up to an order of about 65 to 70%, especially when several preheating devices 49, 49*a*, 49*b* and 49*b* and an embodiment provided with several stages (FIG. 11) are used. Within the scope of the present invention, it is also possible to use more than two hot-pressing devices, one after the other. These devices are not necessarily placed one after the other, but instead of or in addition to the heating devices noted above, there may be ordinary drying cylinders heated by steam therebetween, the web to be dewatered being passed over the cylinders. Additionally, it is important that by means of the hot-pressing in accordance with the present invention, a high dry solids content of the web W can be achieved without compacting the web W excessively, which is favorable in view of several quality properties of the paper. A web W with uniform faces and with a very symmetric structure can also be obtained in particular by means of the two-stage embodiment of the present invention shown in FIG. 11.

In the present invention, the pre-heating/pre-pressing stage can be substantially accomplished in an extended-nip pressing stage $A_1$, $C_2$ through a press felt 12 situated between a glide belt 25 and the web W. In this extended-nip pressing stage $A_1$, $C_2$, the level of compression pressure is within the range of about $p_1$=about 0.1 to 5 MPa, preferably $p_1$=about 0.2 to 1 MPa, with the length of the stage being about 100 to 700 mm, preferably about 200 to 400 mm. A lowering of the pressure and vaporization immediately follows, with a low compression pressure $p_0$ being determined by the tightening pressure $p_0=T/R$ of the glide belt where T=tightening tension of belt 25 and R=radius of the cylinder 10. The length of this stage is within the range of about 30 to 300 mm, preferably about 50 to 100 mm. An intensive nip-pressing stage and blowing-through stage $C_1$, $E_2$ follows, in which the maximum compression pressure used is $p_{max}$=about 5 to 10 MPa, preferably $p_{max}$=about 7 to 9 MPa, with the length of this stage being within the range of about 20 to 130 mm, preferably about 30 to 80 mm. The length of the pre-heating sector $a_0$ and/or the post-heating sector $c_0$, $e_0$ is within the range of about 50 to 100 mm, preferably within the range of about 60 to 80 mm.

Various details of the present invention may vary within the scope of the inventive concepts described above, which have been presented for the sake of example only. Accordingly, the preceding description of the present invention is merely exemplary, and is not intended to limit the scope thereof in any way.

What is claimed is:

1. Method for pressing and dewatering a web, comprising the steps of providing a combination of:

a cylinder having a smooth mantle face which is heatable to a temperature higher than about 100° C. before reaching direct contact with the web, means for heating said cylinder face;

a press roll about which a glide belt is guided and tensioned around the surface of said press roll facing said web, said press roll being arranged to form a roll press nip with said face of said cylinder;

a press shoe arranged before said roll nip in a direction of travel of the web, said press shoe being in close proximity to but not abutting said press roll and said press shoe being the sole element forming an extended press nip with said face of said cylinder substantially immediately before said roll press nip, and a water receiving press fabric arranged to pass through said extended nip and roll nip between the web and said press glide belt, heating said cylinder face to a temperature higher than about 100° C., pressing the web against the cylinder face in said extended nip for a relatively long pressing time and at a relatively low compression pressure, of no more than 5 MPa, lowering the compression pressure after said extended nip so that vaporization of moisture present in the web is intensified as the web laps the cylinder, and in said roll nip against the same cylinder, substantially immediately intensifying the pressure to a peak value that is substantially higher than the pressure applied in the extended nip pressing step, so that vapor is blown through the web and thereby causes some of the moisture present in intermediate spaces between fibers in the web to be blown out, thus intensifying the dewatering, wherein said wet web is heated as it is being brought into contact with said cylinder face during its passage through said extended nip pressing, pressure lowering and pressure intensifying steps.

2. The method of claim 1, wherein the pressure is intensified to a peak value approximately one order higher than the pressure applied in the extended nip pressing step.

3. The method of claim 1, wherein the cylinder face is a smooth mantle of a cylinder of relatively large diameter, and the mantle face is heated to a temperature within the range of about 105° to 500° C.

4. The method of claim 3, wherein the cylinder face is heated by at least one of (a) from inside the cylinder by steam or corresponding heating medium, and (b) from outside the cylinder by at least one of magnetic induction heating, flame heating, microwave heating, and infrared radiation heating.

5. The method of claim 1, comprising the additional steps of detaching the web from the water-receiving press fabric after completion of applying the intensified pressure, transferring the web along the cylinder face to a detaching point, detaching the web from the cylinder face at the detaching point, and transferring the web from said detaching point through an open draw onto a drying wire, by means of a guide roll.

6. The method of claim 1, wherein the relatively low compression pressure in the pre-heating/pre-pressing extended nip pressing step is within the range of about 0.1 to 5 MPa, length of the extended nip in a direction of web travel is about 100 to 700 mm, length of the step at which the compression pressure is lowered is about 30 to 300 mm, and the peak value of the pressure applied in the pressure intensifying step is about 5 to 10 MPa, with length of the intensifying step being about 20 to 130 mm.

7. The method of claim 6, wherein the relatively low compression pressure of the extended nip pressing step is within the range of about 0.2 to 1 MPa and the length of the extended nip is about 200 to 400 mm., the length of the lowered compression pressure step after the extended nip in the direction of web travel is about 50 to 100 mm, and the peak value of the pressure applied in the pressure intensifying step is about 7 to 9 MPa with the length of the intensifying step being about 30 to 80 mm in the direction of web travel.

8. The method of claim 1 wherein said press shoe is a hydrostatic shoe, a hydrodynamic shoe, or a combination of both, and further comprising applying water or a water-oil emulsion as lubricant between the glide belt and the extended nip press shoe.

9. The method of claim 1, wherein the glide belt is a resilient belt.

10. The method of claim 1, wherein the glide belt is a hollow-faced belt, and is arranged to run through the pressing, pressure lowering, and pressure intensifying steps with the hollow face thereof situated in contact with a side of the water-receiving fabric opposite a side of the fabric that contacts the web, to thereby receive water that is pressed out of the web and out of the fabric and to carry such pressed out water away from areas where the pressing, pressure lowering, and pressure intensifying steps are applied.

11. The method of claim 1, wherein dry solids content of the wet web before the extended nip pressing step is within the range of about 15 to 55% and the dry solids content of the web is raised to within the range of about 50 to 70% after the pressure intensifying step.

12. The method of claim 1, comprising the additional step of arranging the extended nip pressing step to cause blowing of vapor through the web to take place, whereby blowing off of the moisture pressed into the intermediate spaces between the fibers in the web and into said press fabric is achieved, with a greater amount of water being pressed out of the web and into the fabric.

13. The method of claim 1, comprising the additional step of initially raising temperature level of the web before the extended nip pressing step by means of a separate pre-heating device which includes at least one of a steam box, an infrared heater, and a high-frequency heater.

14. The method of claim 13, wherein said initial temperature level raising step is carried out by applying heating effect to the web in a press section arranged before said extended nip, when the web is on at least one of a suction sector of a press roll in said press section, a sector of a smooth faced roll arranged between two press nips in said press section, and a suction sector of a transfer-suction roll, with drying belt passing over the transfer-suction roll and conveying the web into the extended nip

15. The method of claim 1, comprising the additional steps of pressing the web after said pressure intensifying step, with a compression pressure generated by means of tension of said press fabric and then detaching the web from the press fabric and passing the web forwardly.

16. The method of claim 1, wherein the web is heated against the cylinder by supplying steam into an interior of said cylinder to heat the face thereof to a temperature higher than about 100° C.

17. Method for pressing and dewatering a web, comprising the steps of providing a combination of:

a cylinder having a smooth mantle face which is heatable to a temperature higher than about 100° C. before reaching direct contact with the web, means for heating said cylinder face;

a first press roll and a second press roll about which a glide belt is guided and tensioned around the surface of said first and second press rolls facing said web said first and second press rolls being arranged to form a first roll press nip and a second roll press nip, respectively, with said face of said cylinder;

a press shoe arranged between said first and second roll nips in a direction of travel of the web, said press shoe being in close proximity to but not abutting said first and second press rolls and said press shoe being the sole element forming an extended press nip with said face of said cylinder, and a water receiving press fabric arranged to pass through said extended nip and said first and second roll nips between the web and said glide belt, heating said cylinder to a temperature higher than about 100° C., pressing the web against the cylinder face in said first roll nip at a first compression pressure, lowering the compression pressure after said first roll nip, pressing the web against the cylinder face in said extended nip for a relatively long pressing time and at a second compression pressure no greater than 5 MPa and relatively lower than the first compression pressure in said first roll nip, lowering the compression pressure after said extended nip so that vaporization of moisture present in the web is intensified, and in the second roll nip substantially immediately intensifying the pressure to a peak value that is substantially higher than the pressure applied in the pressing step in the first roll nip, so that vapor is blown through the web and thereby causes some of the moisture present in intermediate spaces between fibers in the web to be blown out, thus intensifying the dewatering, wherein the web is heated as it is brought into contact with said cylinder face during its passage through the steps of pressing in the first roll nip, pressure lowering after the first roll nip, pressing in the extended nip, pressure lowering after the extended nip and pressure intensifying in the second nip.

* * * * *